United States Patent [19]

Moore et al.

[11] Patent Number: 4,493,362

[45] Date of Patent: Jan. 15, 1985

[54] PROGRAMMABLE ADAPTIVE CONTROL METHOD AND SYSTEM FOR DIE-CASTING MACHINE

[75] Inventors: James I. Moore, Zeeland; Philip J. Van Huis, Holland, both of Mich.

[73] Assignee: Ex-Cell-O Corporation, Troy, Mich.

[21] Appl. No.: 382,528

[22] Filed: May 27, 1982

[51] Int. Cl.[3] ..... B22D 17/32

[52] U.S. Cl. ..... 164/457; 164/155; 164/113; 164/312

[58] Field of Search ..... 164/4.1, 154, 155, 315, 164/457, 458

[56] References Cited

U.S. PATENT DOCUMENTS

| | | | |
|---|---|---|---|
| 3,323,421 | 6/1967 | Olmsted | 164/315 |
| 3,842,893 | 10/1974 | Booth | 164/457 |
| 4,147,200 | 4/1979 | Warsinski et al. | 164/457 |
| 4,213,494 | 7/1980 | Carbonnel | 164/457 |

FOREIGN PATENT DOCUMENTS

| | | | |
|---|---|---|---|
| 100927 | 8/1979 | Japan | 164/155 |

*Primary Examiner*—Kuang Y. Lin
*Assistant Examiner*—Maureen Weikert
*Attorney, Agent, or Firm*—John C. Evans

[57] ABSTRACT

A computerized die-casting machine control includes a microcomputer and a programmable controller having presettable inputs to establish a desired machine operating sequence. Temperature sensors at the holding furnace, cover die, ejector die, gate and at the die impact bushing monitor the die casting variables and produce input signals to the shot-control micro-computer. The micro-computer is programmed to take pre-programmed actions to correct out of tolerance conditions in the machine on a continuous on-line basis during machine operation.

8 Claims, 9 Drawing Figures

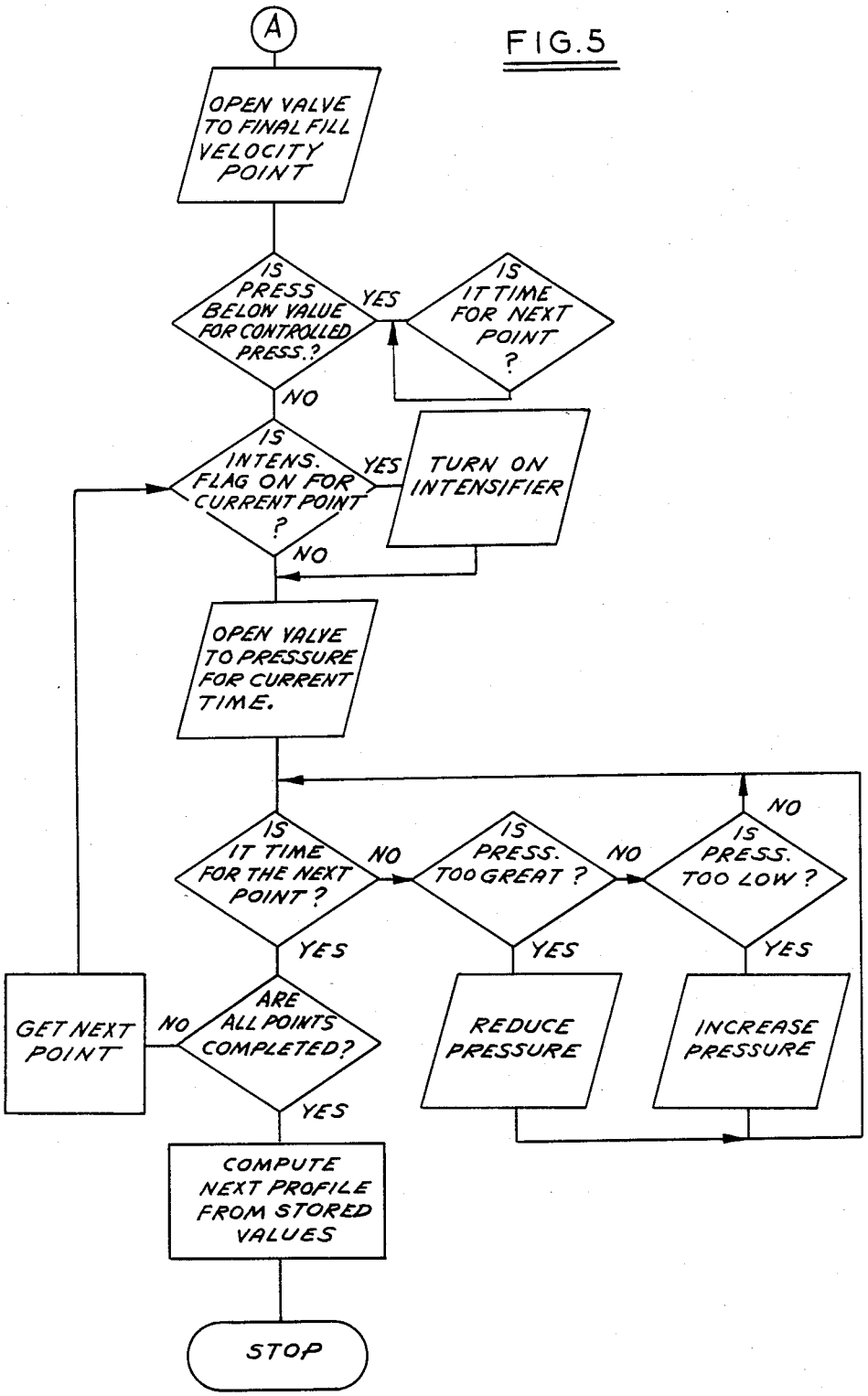
A
FIG.5
OPEN VALVE TO FINAL FILL VELOCITY POINT
IS PRESS BELOW VALUE FOR CONTROLLED PRESS.?
YES
IS IT TIME FOR NEXT POINT ?
NO
IS INTENS. FLAG ON FOR CURRENT POINT ?
YES
TURN ON INTENSIFIER
NO
OPEN VALVE TO PRESSURE FOR CURRENT TIME.
IS IT TIME FOR THE NEXT POINT ?
NO
IS PRESS. TOO GREAT ?
NO
IS PRESS. TOO LOW ?
NO
YES
YES
YES
GET NEXT POINT
NO
ARE ALL POINTS COMPLETED?
REDUCE PRESSURE
INCREASE PRESSURE
YES
COMPUTE NEXT PROFILE FROM STORED VALUES
STOP

PROGRAMMABLE ADAPTIVE CONTROL METHOD AND SYSTEM FOR DIE-CASTING MACHINE

This invention relates to control systems for controlling die casting machines and more particularly to a method and adaptive control for controlling the operation of a die casting machine in accordance with metal temperatures.

BACKGROUND OF THE INVENTION

Die casting is the process developed for manufacturing accurately dimensioned, sharply defined, smooth-surfaced metal parts by forcing liquid metals and alloys, under pressure, into metal dies, where solidification takes place. In simple form it is: "B.T.U.'s in, conform to the configuration of the part desired, B.T.U's out". Optimum casting quality requires minimizing porosity, segregation, shrinkage and inclusions, plus good surface finish.

There are on the market today several types of instruments with which to monitor the die casting process. Examples of these are die temperature controllers, metal temperature controllers, shot speed controllers and measurement devices. All of these units, however, require an individual with technical knowledge to interpret the information provided by these instruments. The technician must then make the proper adjustments to correct any problem that may exist.

These variables in the die cast process interact with each other in several ways, making proper assessment of these variables on an individual basis very difficult. Rather, they must be examined simultaneously, because changes in any or all of the variables could affect the quality of the die cast product. Thus, the human approach is undesirable where rapid solutions are required. The fastest, most accurate approach, is to analyze the data collected from the die cast machine on a digital computer, and feed back the adjustments necessary through a P.C. controller.

Prior control systems have included a servo controlled shot cylinder for a die-casting machine including a quick response linear displacement transducer for producing a signal of shot ram velocity. Programmable means are provided for comparing the actual shot ram velocity with a command velocity signal and means operative in response to the comparison cycle a hydraulic servo valve to on-off states thereby to produce modulation of flow from a hydraulic shot valve to compensate for changes in velocity produced by operating variances in fluid mechanics of the system.

An object of the present invention is to improve a system of the preceding type by the provision of an additional micro-computer and associated sensing means for monitoring die casting variables including metal temperature, and die temperature and wherein these variables are compared with pre-set values to adjust the shot cylinder.

A further object of the present invention is to provide an improved method of die-casting including measuring the material temperature in the outlet region of an injection chamber just prior to a pressure casting shot; comparing this temperature against a pre-set value that was previously established by the operator during set-up; and, if the metal temperature is below the preset value, increasing the shot speed accordingly and if the temperature is higher than the preset value, reducing the shot speed and if the material temperature is at predetermined out-of-limits so that the shot speed cannot be compensated, terminating the machine cycle.

A further object is to provide an improved method as set forth in the preceding object wherein die temperature is measured just prior to shot and during a dwell period and shot speed adjustments are based on the die temperature, in the same manner as with the metal temperature; and, during the dwell period, when the die temperature drops to a preset limit, opening the die to open to eject the casting.

Yet another object is to provide an improved method as set forth in the two preceding objects including monitoring a shot cylinder position while the casting shot is moving forward, and triggering a fast shot when hot metal is detected at the die-casting gate and time controlling the length of fast shot based on a required cavity fill time; and if the shot plunger's cylinder position exceeds a preset value (based on metal volume), aborting the shot.

Another object of the present invention is to provide an improved control system for a die-casting machine including providing a programmable computer and sensing means for measuring the metal temperature at multiple points in the metal injection flow paths of the machine including sensing means for measuring the metal temperature at least in the outlet region of a cold chamber of a die-casting shot; the programmable computer instantaneously comparing the sensed metal temperature with a pre-set computer input value and either increasing or decreasing a shot speed command signal to adjust the shot speed of the machine.

Still another object is to provide an improved control system of the type set forth in the preceding object wherein second sensing means are provided to sense die temperature just prior to the die casting shot and during the dwell period and resultant signals of die temperature are instantaneously compared with pre-set values of desired die temperature to adjust the shot speed in accordance with die temperature in the same manner as with the first sensed metal temperature and to instantaneously compare the die temperature as it drops during the machine's dwell period with a pre-set dwell limit temperature to produce a signal to open the die and eject the die-casting at the completion of a casting cycle.

Another object of the present invention is to provide an improved control system for a die-casting machine as set forth in either of the precedingobjects by the provision of means for monitoring the shot plunger's cylinder position and means for sensing when hot metal is detected at the gate to the casting cavity and including a computer program that instantaneously compares the occurrence of the gate metal signal with a preset timed period value of fast shot length based upon the time required to fill the die cavity; the computer including means operative to abort the shot if the metal-at-gate condition is sensed when the shot plunger's cylinder position exceeds a pre-set value (based on metal volume).

These and other objects and features of the present invention will be apparent to those skilled in the art to which it relates from the following description made with reference to the accompanying drawings.

These and other objects and features of the present invention will be apparent to those skilled in the art to which it relates from the following description made with reference to the accompanying drawings.

BRIEF DESCRIPTION OF THE DRAWINGS

FIGS. 4–6 illustrate the flow chart diagrams outlining the software for the microcomputer utilized in the preferred embodiment of the invention.

BEST MODE FOR CARRYING OUT THE INVENTION

Figure 1:
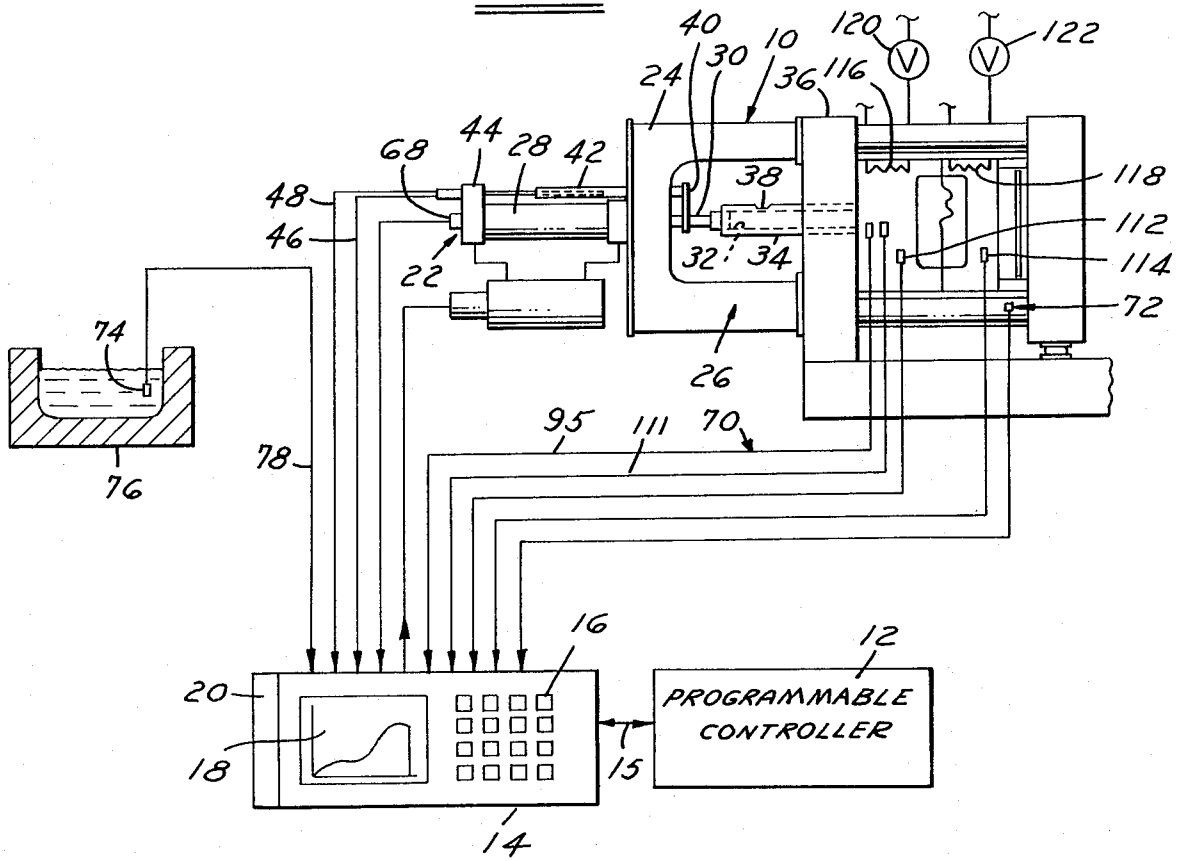
FIG. 1 is a block diagram of a control system of the present invention.

Referring now to FIG. 1, a die-casting machine 10 is controlled by a programmable controller 12. Microprocessor 14 communicates with the programmable controller through a data bus 15. The microprocessor 14, can be a known input/output (I/O) digital computer, which in turn communicates with the I/O terminals of the programmable machine controller. The operator communicates with the microprocessor and the programmable controller by a keyboard 16. All of this can be displayed on a CRT 18 which will direct the operator to answer the proper communications for each job. Once these questions are answered and the job is running, this information is stored either on a floppy disk memory 20, or in a central computer for future use. The die casting machine 10 is of the type more specifically set forth in U. S. Pat. No. 4,064,928 issued Dec. 27, 1977 to Wunder for Die Casting Machine.

The machine 10 includes a shot assembly 22 mounted on a vertical face plate 24 of a C-frame bracket 26. The shot assembly includes a hydraulically operated shot cylinder 28 that drives a reciprocable output plunger 30 which reciprocates in a shot chamber 32 (usually referred to as a "cold chamber" in a cylinder or sleeve 34 mounted on a front plate 36 of the machine. Molten metal such as aluminum is poured into an inlet 38 of the cold chamber and the plunger is reciprocated to force the liquid metal into a die cavity.

A carriage 40 connected to plunger 30 drives a movable position indicating tube 42 with respect to a linear displacement transducer 44 which produces a DC output signal on line 46 indicating the position of the ram 30 and a DC output signal on line 48 indicating the velocity of ram 30 during programmed operation of the machine. The velocity signal is directed to a pilot valve amplifier circuit for closed loop velocity control of the machine. The position signal is directed to an analog input module of the programmable controller 12. The programmable controller 12 is more specifically set forth in our co-pending U.S. Ser. No. 331,350, filed Dec. 16, 1981 for Shot Cylinder Control which is incorporated herein by reference. Controller 12 controls the shot cylinder speed to compensate for changes in the temperature of hydraulic fluid in the machine and other operating variables which can affect the finished casting.

More particularly, in the illustrated machine two distinct but related systems are present including (1) the molten metal to be cast and (2) the machine shot mechanism. The present invention produces an on-going analysis of (1) the behavior of the shot cylinder, (2) die temperature; (3) metal temperature/shot speed; (4) metal temperature/cycle time; and (5) temperature/-metal holding and (6) die spray which in turn reflects the dynamic characteristics of the metal injection flow and the resultant character of the finished casting.

The memory of the programmable controller 12 is set by thumbwheel switches pre-setting desired slow shot velocity, fast shot velocity, low impact velocity and follow through velocity respectively. The controller 12 can also control machine functions such as start-up and the like. The velocity control switches are used to preset shot speed values into the memory of controller 12. Additional presettable memory is established by position control thumbwheel switches for setting shot retracted position, fast shot position, low impact position and start intensifier position.

The microprocessor 14 can be one of several microprocessors on the market that communicate with people in basic language and which require very little training in their use. The processor would have real-time multitask unit which provides simultaneous execution of multiple, independent tasks with fast, efficient task development. Such systems enable the execution in the order of 20 independent tasks simultaneously. These tasks operate independently of each other, may be assigned priorities as required, or can be suspended for a specified time. The microprocessor modifies the control of pilot valve amplifier circuit 50 by the controller 12. Circuit 50 receives a velocity feedback signal from transducer 44 via line 46.

Figure 2:
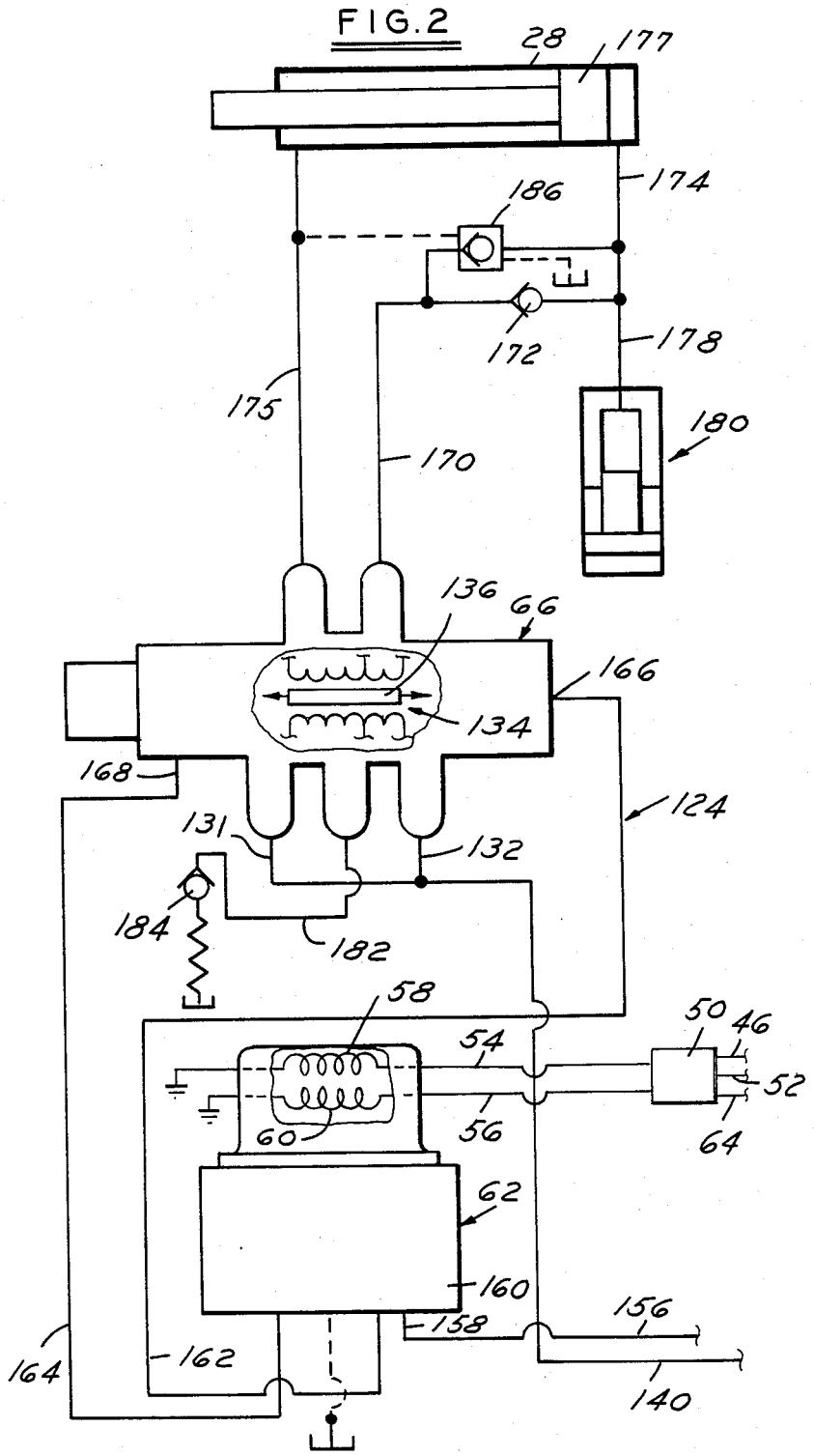
FIG. 2 is a diagrammatic view of the output of a hydraulic system controlled by the control of FIG. 1.

The pilot valve amplifier 50, shown in FIG. 2, also has a command signal line 52. For purposes of the present invention the amplifier 50 is shown diagrammatically, and the details and function are set forth specifically in above U.S. Ser. No. 331,350.

A resultant amplified output signal is produced at output terminals 54, 56. Servo coils 58, 60 of hydraulic servo pilot valve 62 are connected across terminals 54, 56. A spool position feedback signal is produced on line 64 from an LVDT Olmsted valve 66 to cause the amplifier circuit 50 to produce an on-off energization of the pilot valve 62.

The present invention utilizes the aforesaid on-off control of the servo valve 62 and additionally includes the micro-processor 14 with inputs/outputs (I/O) terminals to receive machine process signals and a software program to produce an adaptive loop adjustment of pre-set machine cycle shot speeds, cycle times, metal and die temperatures and the like. The adaptive loop includes pressure sensor means 68, temperature sensor means 70 and clamp tension sensor means 72 to control the die-cast machine process within pre-set constraint limits to optimize its operation.

In a preferred embodiment the temperature sensor means 70 includes a thermocouple 74 sensing the liquid metal in a holding furnace 76. It directs an input signal via line 78 to an I/O terminal of the micro-computer.

Figure 7:
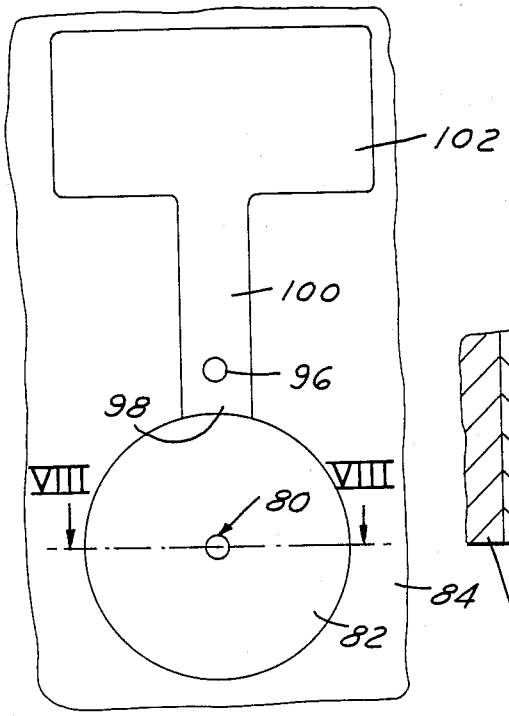
FIG. 7 is an elevational view of the ejector die and thermocouple locations.
Figure 8:
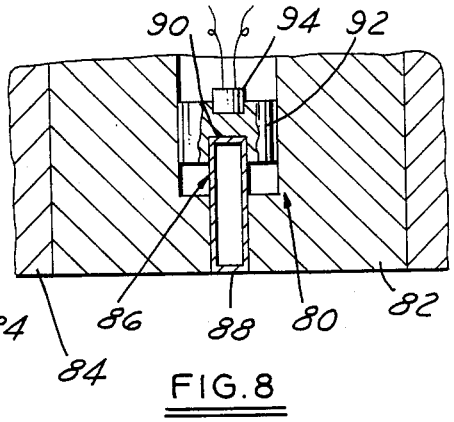
FIG. 8 is a fragmentary sectional view taken along the line 8—8 of FIG. 7.

The temperature sensor means further includes a cold chamber sensor 80 which preferably will be located at the impact bushing 82. As seen in FIGS. 7 and 8 the bushing 82 is located in the ejector die 84 in line with the outlet from the shot cylinder or sleeve 34. The sensor 80 includes a heat pipe 86 embedded in bushing 82 to instantaneously sense the temperature of metal flowing from the cold chamber 32. The evaporator end 88 of pipe 86 is exposed to the metal prior to entrance into the die gate defining runners to the die casting cavity. The condenser end 90 of pipe 86 is coupled through an adapter 92 to a thermocouple 94 having its leads connected to line 95 so as to direct an instantaneous reading of inlet metal temperature to computer 14 at the start of the casting shot sequence.

Figure 9:
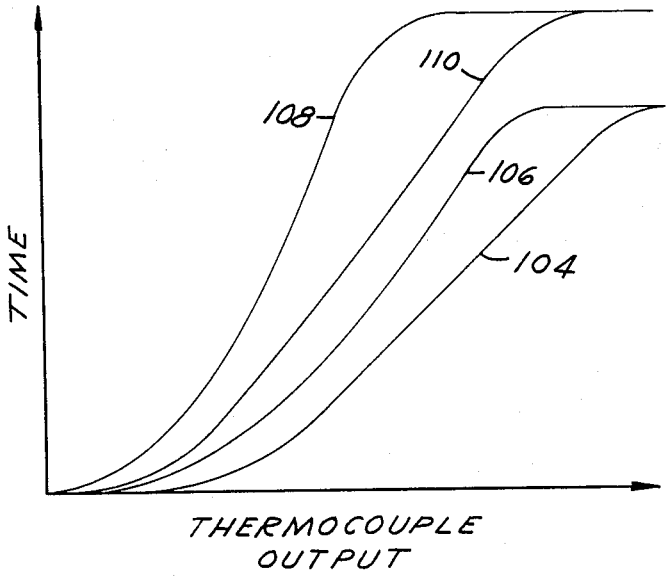
FIG. 9 is a response curve chart for a gate thermocouple in the present invention.

A further element in the temperature sensor means 70 is a thermocouple 96 which is located at the inlet end 98 of the gate 100 leading to the die casting cavity 102. As seen in FIG. 9, thermocouple 96 has a temperature to output (milliamps) relationship which varies in accordance with the inlet temperature. If the slope of the response curve is within a desired range as preset in the computer 14, it indicates that enough metal is present in the cold chamber 32 or other feed system to fill the die-casting cavity 102 for a given casting and slow feed stroke. More specifically, if not enough metal is present to fill the cavity an actual thermocouple response curve 104 may appear for a metal temperature of 1100° F. The computer memory has been preprogrammed to require a response curve slope as shown on curve 106 for a metal temperature of 1100° F. The lesser slope of curve 104 indicates that metal quantity is insufficient for cavity fill assuming given initial plunger stroke, velocity and other operating functions within limit. Curve 108 shows an actual response curve for a higher metal temperature 1200° F. meeting required pre-set profiles and curve 110 shows an actual response curve with a slope less than that required to assure cavity fill.

The signal from thermocouple 96 is directed via line 111 to another of the I/O terminals of micro-computer 14.

Other components of sensor means 70 include thermocouples 112, 114 embedded respectively in the die cover and the die ejector 84. The thermocouples 112, 114 constantly indicate changes in the die temperature which can vary within a range of plus or minus 50° F. during machine operation depending upon the effectiveness of control of die cooling loops 116, 118 in the dies and having coolant flow therethrough automatically controlled by servo-controlled coolant valves 120, 122, respectively.

The thermocouples have nano-second response characteristics. Sensor 80 indicates inlet metal temperature and thermocouple 96 indicates the location of the metal in the injection system instantaneously following the beginning of the shot stroke.

These input signals are constantly monitored by the computer against desired preset values in order to produce an adaptive loop control by the computer which establishes an output signal which is fed to controller 12 according to actual mold and die temperatures that exist immediately prior to the shot to thereby to control valve 62 to produce an ideal plunger speed for the actual die and metal temperatures.

Figure 3:
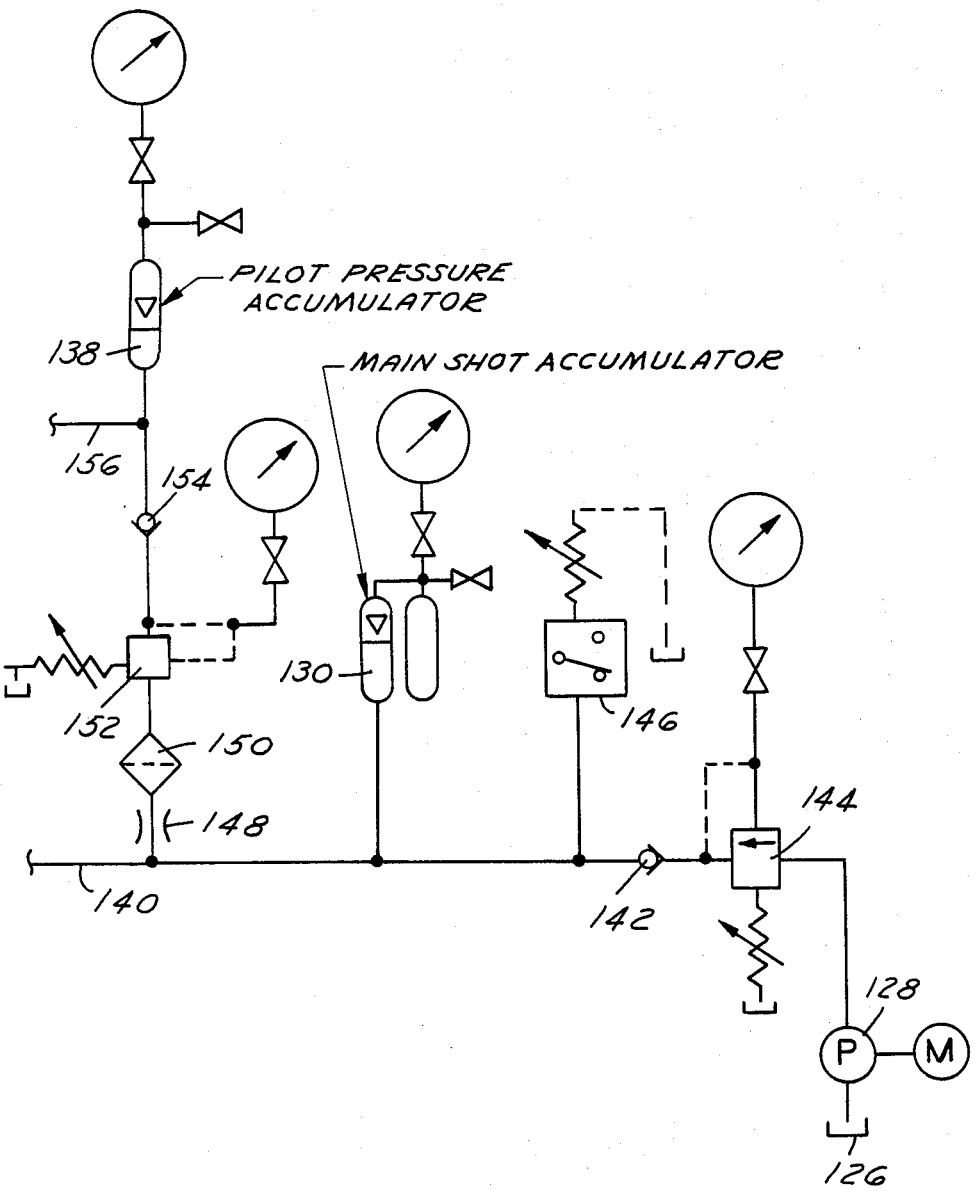
FIG. 3 is a diagrammatic view of the supply of a hydraulic system controlled by the system of FIG. 1.

Referring now more specifically to FIGS. 2 and 3, a servo system 124 is shown controlled by amplifier 50. It has a hydraulic supply or pressure medium from a tank or reservoir 126. A pump 128 directs the medium to a main shot accumulator 130 and inlet conduits 131, 132 to Olmsted valve 66 with a built-in linear voltage transducer (LVDT) 134 which has a plunger 136 driven by the spool of valve 66 to check spool motion at two points (can be set as close as 0.010 inches) to maintain a pulsing signal at line 64 and a resultant modulated drive of valve 66 so that valve opening can be adjusted to maintain a desired pre-set speed rate of shot cylinder drive to compensate for machine operating variables such as changes in temperature of hydraulic fluid in the shot cylinder because of system operation.

The illustrated servo controlled hydraulic drive system includes a pilot pressure accumulator 138. More specifically, both accumulators 130, 138 are connected to a supply conduit 140 from pump 128 across check valve 142. Pressure in accumulator 130 is regulated by a pressure reducing valve 144 set at a maximum accumulator pressure of 1800 psi. A pressure switch 146 in conduit 140 is set 50 psi below the pressure in accumulator 130. Pilot pressure is established by flow and pressure across a series connected orifice 148, filter 150, pressure reducing valve 152 and check valve 154 to charge the pilot pressure accumulator 138. Valve 152 is set at a maximum servo pressure of 1000 psi.

The pilot pressure accumulator 138 supplies a pilot pressure inlet line 156 to a pilot pressure inlet port 158 of a housing 160 for pilot control valve 62.

For purposes of the present invention it should be understood that an on-off control signal from amplifier circuit 50 causes either full clockwise or full counterclockwise torque on an armature of valve 62. The valve spool will remain displaced in either a right or left position depending upon the state of the on-off amplifier output signal.

The second stage of the valve is a four-way spool design with outlet flow from ports 162, 164 which are fully opened or fully closed as the flapper feeds the respective ends of the valve spool.

The outlet ports 162, 164 are connected, respectively, to the spool ends 166, 168 of the spool of Olmsted valve 66. Valve 66 is a third stage shot valve with axial flow and a floating spool which is balanced dynamically as well as statically under high flow conditions. Hence the valve 66 establishes an extremely accurate flow of hydraulic fluid to establish a shot cylinder velocity that is compensated for changes in machine variables such as temperature of the hydraulic fluid which varies as the die casting machine is operated. In the illustrated system, modulated flow is through outlet 170, thence across check valve 172 to an inlet 174 at one end of the shot cylinder 28 or directly through line 175 to the opposite end of cylinder 28 depending upon whether the ram piston 177 is advancing or retreating.

An intensifier connection 178 is connected to a multiplier cylinder 180 of conventional form well known to those skilled in die casting. Suitable connection to drain is provided from opposite sides of shot piston 30 through line 182 from valve 66.

During shot movement of piston 30 the Olmsted valve 66 is positioned so that modulated hydraulic flow passes from valve 66 through line 170 to the right side of ram 177 as viewed in FIG. 2. Return flow of hydraulic fluid on the opposite side of ram 177 is through line 175, valve 66, and drain line 182 thence through check valve 184. During opposite retract movement of ram 177, the pressure line 175 is connected through modulating spool to supply conduit 140. Return flow from the opposite side of ram 177 is through PO check valve 186; thence through line 170 to drain.

The operation of the system includes a known slow shot cycle in which known system hydraulics are conditioned to maintain a prefilling phase. Thereafter, a fast shot cycle is established for mold filling. During these operations the pressure acting on the shot ram 177 is substantially lower than the pressure prevailing in accumulator 130.

At the instant of final mold filling with the molten metal, the intensifier cylinder 180 is operative to cause the hydraulic pressure acting on ram 177 to increase rapidly.

During follow through, hydraulic means are provided to effect a post pressurization of the molten metal to be cast during the solidification period in the mold.

Following solidification, the shot cylinder is retracted.

The present invention is adaptable to a wide range of hydraulic systems and, accordingly, for purposes of simplifying understanding of the invention, details of the intensifier circuit and other hydraulic components of known die-cast machines are omitted.

The provision of the position velocity transducer 44 and its use to produce position and velocity control signals, position to produce a command signal and a velocity to produce a feedback signal, can be incorporated in the adaptive control of the present invention wherein the amplifier 50 drives the servo pilot valve 62 in proportion to the difference between the command and feedback signals. Further, the output of amplifier 50 is such that the pilot valve is conditioned on-off. The rate of the on-off control in turn establishes the degree of pressure modulation produced by Olmsted valve 66 to maintain a desired shot cylinder ram speed (as pre-set or adjusted by the adaptive control) regardless of machine operating variables such as shot cylinder ram fit, cold metal and fluid velocity.

The computer 14 enables further variables to be inputted to the control. Examples of set-points which can be entered into the computer 14 by the operator during machine set-up include (1) cavity fill time "t"; (2) type alloy being used; (3) plunger stroke and diameter; (4) optimum metal temperature; and, (5) shot speed command.

Figure 4:
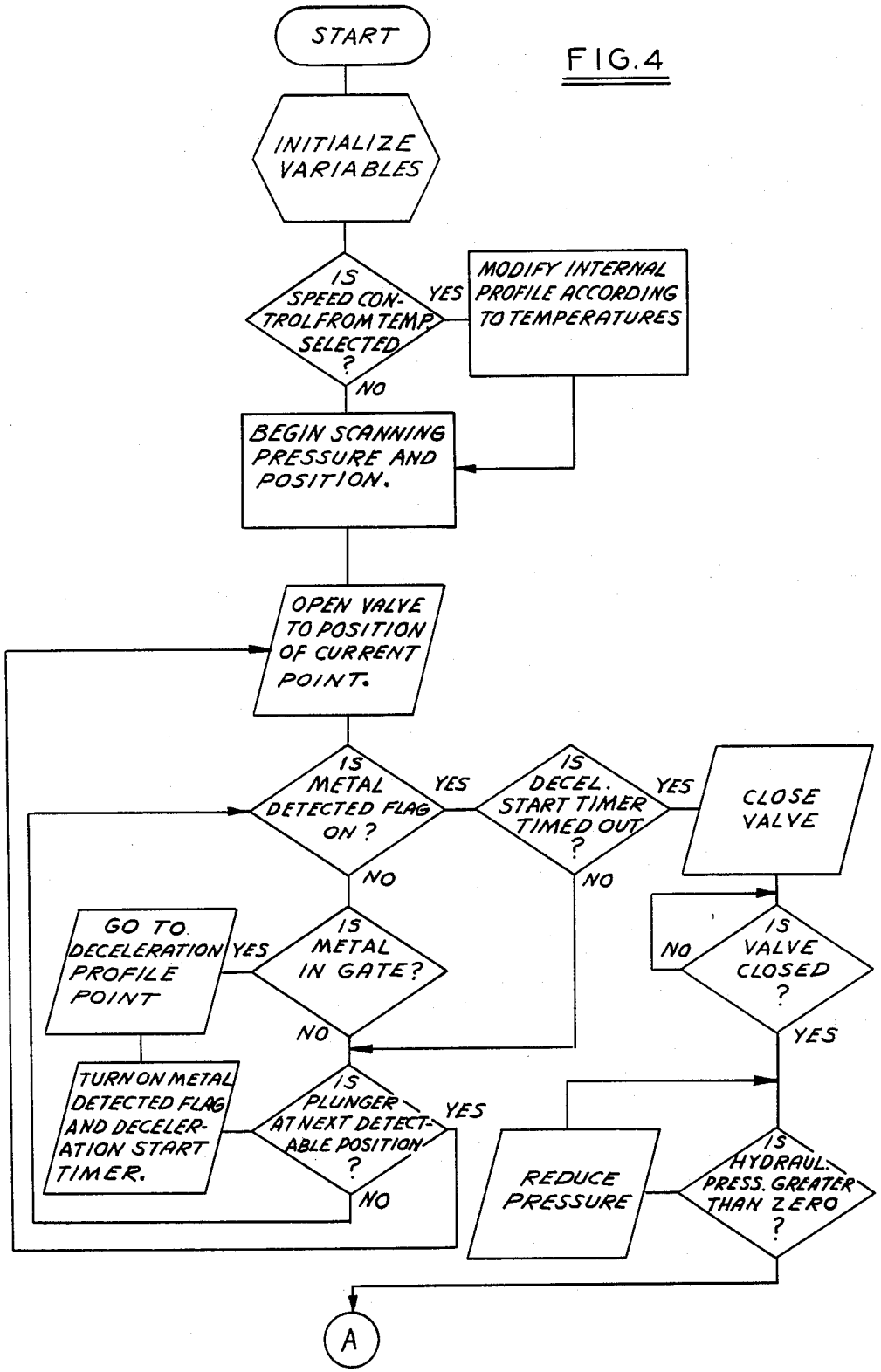
Figure 6:
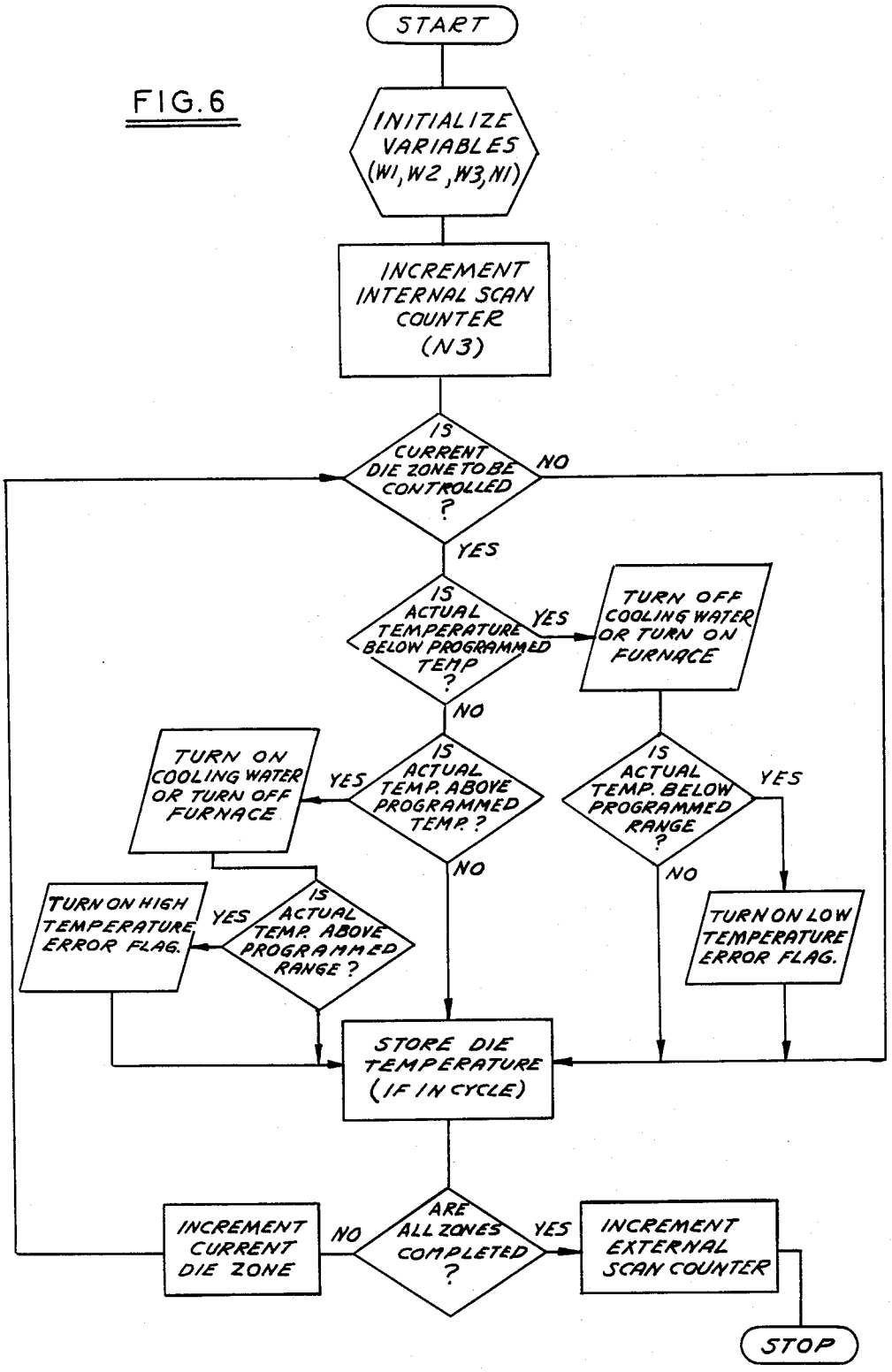

Flow charts of computer software to accomplish the adaptive control are shown in FIGS. 4–6. The flow chart legend includes an oval box for terminal points in the flow chart. Hexagonal boxes are preparation steps in the program. Rectangular boxes are process and/or annotation steps in the software program.

Parallelogram-shaped boxes are inputs and outputs in the program and diamond-shaped boxes are decision points in the program.

As set forth in the flow chart diagrams in FIGS. 4–6, when a temperature/speed program selection is made by depressing keys on the keyboard 16 to enter set-points, it is identified as "Initialized Variables" in the flow chart of FIG. 4. The operator has the choice of inputting the cavity filling time which is represented by the decision box "Is Speed Control from Temperature Selected?". If a filling time is selected the internal profile of the computer will be modified according to the following equation for cavity filling time:

$$t = K\frac{Tg - Tlig + F}{Tlig - Td} \times T$$

wherein cavity filling time=t.

Tg=metal injection temperature;

Tliq=metal liquidus temperature; K is a constant reflecting die steel type; F is a constant reflecting alloy type time percent solids in the injected metal and T is casting thickness.

Tg and Td are inputted by the operator initially with high and low limits. At each machine lock-up Tg and Td are measured and the computer modifies the internal profile of the computer according to the measured temperatures as shown in the process box to the right of the first decision point in FIG. 4.

The inputs of pressure from transducer 68 measuring cylinder hydraulic pressure and positions signal from transducer are then scanned by the computer.

Fast speed plunger speed is computed by:

$$Vp = \frac{4V}{tD^2}$$

where V (volume of all castings and overflows) and D (metal plunger diameter) are inputted by the operator. The volume ladled V1 is also inputted by the operator. (The operator could also be given the option of inputting the shot weight and/or castings+overflows weight which the controller would immediately convert to volume.)

The operator must enter the length of the shot sleeve inside the die plus the biscuit well depth. Once the above data is entered the following plunger positions are to be computed.

$P_1$=At rest position of plunger 30 in cylinder 32 (This value is pre-set by the machine and position transducer calibration)

$P_2$=Another pre-set position at which the plunger 30 has advanced far enough in cylinder 32 to be past the pour hole or chamber inlet.

As shown in the flow chart, the valve 66 is controlled to open so that the plunger 30 will move a pre-programmed speed (i.e., 10 in/sec) from $P_1$ to $P_2$.

$P_4$=A hypothetical position of the plunger 30 in cylinder 32 where it would contact the ejector die 84. The operator inputted value for the length of the shot sleeve 34 in the die cover is added to the biscuit pocket depth and a permanently entered distance between $P_1$ and the machine's die mounting surface to get the effective shot sleeve length. That length is added to $P_1$ to get $P_4$.

$P_3$=The position of the plunger 30 in cylinder 32 when the volume of molten metal ladled and poured through inlet 38 will fill the diameter of the shot sleeve.

$$P_3 = P_4 - \frac{4\,V1}{D^2}$$

The fast plunger speed $V_p$ begins at position $P_3$ and is maintained until the shut-down position described below.

The plunger is accelerated uniformly from the aforesaid pre-programmed speed of 10 in/sec at position $P_2$ to $V_p$ at position $P_3$. The thermistor 80 that measures metal temperature just prior to shot initiation to compute Vp (above) is located near the gate in the die. When the incoming molten metal flows across it, a sharp temperature increase will be sensed, shown as "Metal Detect Flag" decision in the flow chart of FIG. 4. Once the plunger passes position $P_3$, the controller sees that temperature rise. When the temperature rise occurs, the controller waits a time interval, as shown by decision box "Deceleration Start Timer timed out", and then closes the shot valve at the illustrated output box. Closing the shot valve stops the plunger and traps the impact of the system. The time interval is determined by:

tli=t−tr t=cavity filling time as calculated above tr=constant for the system reaction time.

There is a chance that the machine can not achieve the fast shot plunger speed Vp. In these instances the controller should display a diagnostic statement like:

REQUIRED PLUNGER VELOCITY IS NOT BEING ACHIEVED. CHECK SHOT SYSTEM HYDRAULIC PRESSURE, ACCUMULATOR CHARGE AND GATE SIZE. IF THESE ARE OK USE PQ 2 TO PICK CORRECT PLUNGER AND GATE SIZES.

If the calculated plunger velocity $V_p$ is greater than the "dry shot" speed available, the following diagnostic should appear.

REQUIRED PLUNGER VELOCITY IS NOT POSSIBLE. USE PQ 2 TO PICK CORRECT PLUNGER AND GATE SIZES.

(The dry shot speed is measured when machine is "run off" before shipment and permanently entered in the control.)

Each time a shot is made, the plunger speed Vp and the actual speed between point $P_3$ and tli sec. after $P_3$ is displayed.

If the die or metal temperature has exceeded the ± tolerance inputted, the above diagnostics should also include the statement:

DIE (OR METAL) TEMPERATURE IS ABOVE (OR BELOW) THE TOLERANCE INPUTTED.

The next step in the flow chart of FIG. 5 is a controlled ramping of hydraulic pressure at the instant cavity 102 is filled. The ramp time is pre-set by the operator.

The transducer 68 for pressure of cylinder 28 and transducer 44 for position and velocity of shot ram 177 are directly communicated to the micro-processor 14. A flow chart of actual on-line conditions is shown in FIG. 5. If pressure is too low to produce desired hydraulic pressure the intensifier flag will be conditioned so that the intensifier will be turned on and valve 66 will be opened to pressure the system to produce an adaptive loop control of the plunger velocity.

Die opening is accomplished by the controller when die thermistor or thermocouple indicates that the casting temperature has fallen to an operator inputted set point. It will not react to a rising temperature. The set point will be determined by experimentation usually, since the sensor will not read absolute casting temperature. A "timed" mode must be available in which the die is opened with a timer and the sensor's reading at the time of opening is displayed. Such data will help determine the set-point.

As shown in the flow chart of FIG. 6, the temperature is controlled by having the controller open and/or close solenoid valves 120, 122 on the die cooling water lines 116, 118 when thermistor or thermocouple readings from the die are above (open valve) or below (close valve) operator inputted set points. The controller should have multiple channels of such control. There must be a "monitor/set" mode that displays actual temperature to assist in determining the best set points. The controller should read each temperature sensor once each second. When the operator interrupts the cycle, all set points should automatically be temporarily reset to the "die temperature". When the regular cycle is reinitiated, the temperatures set points are to return to the operator inputted settings. A similar flow chart can be developed to provide machine control inputs from microprocessor 14 to control the machine in accordance with the tie-bar stress conditions as sensed by strain gage 72.

What is claimed is:

1. A method of operating a pressure molding machine of the type having a material injection chamber with an outlet region leading to a die cavity runner which directs molten material to a die cavity for solidification during a dwell period and in which chamber an injection plunger reciprocates to inject molten material comprising the steps of selecting a predetermined desired temperature for molten material in the outlet region measuring the actual temperature of the molten material in the outlet region of the injection chamber just prior to a plunger shot; comparing the actual temperature and the previously established desired temperature and, if the actual temperature is below the desired temperature increasing the shot speed of the plunger accordingly and if the temperature is higher than the desired temperature reducing the shot speed of the plunger and if the actual temperature is at predetermined out-of-limits range from the desired temperature so that the shot speed cannot be compensated, terminating the machine plunger shot cycle.

2. In the method of claim 1, preselecting a desired die temperature, measuring actual die temperature just prior to the plunger shot and during a material solidification dwell period, and adjusting shot speed of the plunger during material injection by increasing plunger speed if the actual die temperature is below the preselected desired die temperature and, when the die temperature drops to a preset limit, opening the die to open and eject the casting.

3. In the method of claim 1, monitoring shot plunger position while the casting shot is moving forward, and triggering a fast shot when molten material is detected at the die cavity runner and time controlling the length of fast shot based on a required cavity fill time; and aborting the shot if the shot plunger position exceeds a preset position in the material injection chamber at the time when molten metal is detected at the die cavity runner.

4. In the method of claim 2, monitoring shot plunger position while the casting shot is moving forward, and triggering a fast shot when molten material is detected at the die cavity runner and time controlling the length of fast shot based on a required die cavity fill time; and aborting the shot if the shot plunger position exceeds a preset position in the material injection chamber at the time when molten material is detected at the die cavity runner.

5. A control system for a machine of the type having a material injection chamber with an outlet region leading to a die cavity runner which directs molten material to a die having a cavity for solidification during a dwell period and in which chamber an injection plunger reciprocates to inject molten material comprising a programmable computer means, means selecting a predetermined desired temperature for molten material in the outlet region, said programmable computer means including store means for registering said predetermined desired temperature, and sensing means for measuring the material temperature at the outlet region of the material injection chamber; the programmable computer means including means for instantaneously comparing the sensed actual material temperature with said stored predetermined desired temperature for molten material in the outlet region and either increasing or decreasing a shot speed command signal to adjust the shot speed of the machine in accordance with the difference between the actual temperature and selected temperature.

6. In the combination of claim 5, means for pre-setting a desired die temperature in said programmable computer means, second sensing means for sensing actual die temperature for signaling actual die temperature just prior to material injection and during the dwell period, means for comparing said actual die temperature with pre-set values of desired die temperature and for adjusting the shot speed in accordance with actual die temperatures and means responsive to the die temperature as it drops during the machine's dwell period with a pre-set dwell limit temperature to produce a signal to open the die and eject the casting at the completion of a casting cycle.

7. In the combination of claim 5, means for monitoring shot plunger position in said chamber, means for sensing when molten material is detected at the die cavity runner, means for instantaneously comparing the occurrence of the molten material in the cavity runner with a preset timed period of plunger movement in said chamber based upon the time required to fill the die cavity; and means operative to abort the shot if the molten material is sensed in the die cavity runner and the shot plunger position in the material injection chamber exceeds a pre-set value.

8. In the combination of claim 6, means for monitoring shot plunger position and means for sensing when molten material is detected at the die cavity runner, means for instantaneously comparing the occurrence of the molten material signal in the cavity runner with a preset timed period of plunger movement in said chamber based upon the time required to fill the die cavity; and means operative to abort the shot if the molten material is sensed in the die cavity runner and the shot plunger position in the material injection chamber exceeds a preset value.

* * * * *